US006229903B1

(12) United States Patent
Kobayashi

(10) Patent No.: US 6,229,903 B1
(45) Date of Patent: May 8, 2001

(54) MOUNTING STRUCTURE FOR ELECTROMAGNETIC SOUND GENERATOR

(75) Inventor: Takashi Kobayashi, Fujiyoshida (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 0 days.

(21) Appl. No.: 09/332,598

(22) Filed: Jun. 14, 1999

(51) Int. Cl.[7] ..... H04K 25/00

(52) U.S. Cl. ..... 381/410; 381/361; 381/409; 381/417; 381/431; 367/173

(58) Field of Search ..... 381/87, 189, 360, 381/361, 355, 374, 396, 398, 409, 410, 417, 431, FOR 152, FOR 165; 29/594; 367/172–173, 175

(56) References Cited

U.S. PATENT DOCUMENTS

| | | | | |
|---|---|---|---|---|
| 4,506,117 | * | 3/1985 | Fresard | 381/396 |
| 4,608,463 | * | 8/1986 | Burgess et al. | 381/396 |
| 4,691,363 | * | 9/1987 | Khanna | 381/87 |
| 4,837,836 | * | 6/1989 | Barcus | 381/361 |
| 5,394,479 | * | 2/1995 | Ishigaya et al. | 381/396 |
| 5,619,585 | * | 4/1997 | Grasso | 381/386 |
| 5,719,549 | * | 2/1998 | Lai | 381/386 |
| 5,721,785 | * | 2/1998 | Imahori | 381/386 |
| 5,960,096 | * | 9/1999 | Imahori et al. | 381/396 |
| 6,097,828 | * | 8/2000 | Suzuki et al. | 381/396 |
| 6,108,432 | * | 8/2000 | Watanabe | 381/398 |

FOREIGN PATENT DOCUMENTS

| | | | | |
|---|---|---|---|---|
| 2542549 | * | 9/1984 | (FR) | 381/152 |

* cited by examiner

*Primary Examiner*—Curtis Kuntz
*Assistant Examiner*—Suhan Ni
(74) *Attorney, Agent, or Firm*—Koda & Androlia

(57) ABSTRACT

An electromagnetic sound generator is mounted on a substrate. The electromagnetic sound generator has a case housing an electromagnet, which is formed by attaching a magnet and a coil to a yoke, and a vibrating plate disposed so as to face the electromagnet, and electrodes, to which terminals of the coil are connected, projecting outwardly of the case. The substrate has an accommodating portion conforming to the case, and substrate electrodes provided on the substrate surface at the circumference of the accommodating portion. The electromagnetic sound generator is mounted on the substrate by accommodating the case in the accommodating portion of the substrate and joining the electrodes of the electromagnetic sound generator to the substrate electrodes.

5 Claims, 7 Drawing Sheets

MOUNTING STRUCTURE FOR ELECTROMAGNETIC SOUND GENERATOR

BACKGROUND OF THE INVENTION

1. Field of the Invention

This invention relates to a structure for mounting an electromagnetic sound generator which generates sound by vibrating a vibration plate using an electromagnet.

2. Description of the Related Art

In the prior art, surface-mounted electromagnetic sound generators of the kinds shown in FIGS. 10 to 13 and FIGS. 14 to 17 are the thinnest and smallest available and are capable of high-density mounting. As shown in the diagrams mentioned, an electromagnetic sound generator of this type includes a case 2 in which are housed an electromagnet 10 comprising a yoke 4, a magnet 6 and a coil 8, and a vibrating plate 14 supported facing the electromagnet 10 by a ring-shaped vibration-plate supporting ring 12. The case 2 is insert-molded to have a pair of electrodes 20, 22 for connecting the coil 8, which is contained within the case 2, to substrate electrodes 18 on a substrate 16, and a dummy electrode 24 for providing greater fixing force.

The electromagnetic sound generators having the structure described above are mounted on the substrate 16 by fixing connecting portions 20*a*, 22*a*, 24*a*, 24*b* of the electrodes 20, 22 and dummy electrode 24 exposed at the exterior of the case 2 to respective ones of the substrate electrodes 18 on the substrate 16 by solder 26, as illustrated in FIGS. 11, 12 and FIGS. 15, 16.

In the conventional electromagnetic sound generators described above, the connecting portions 20*a*, 22*a*, 24*a*, 24*b* of the electrodes 20, 22 and dummy electrode 24 are formed by causing these electrodes to protrude from the bottom of the case 2 or by bending the electrodes toward the side face of the case 2. The electromagnetic sound generator is mounted on the substrate 16 with the connecting portions 20*a*, 22*a*, 24*a*, 24*b* being superimposed on the substrate electrodes 18. In order to deal with a further reduction in device thickness and size and an increase in mounting density, therefore, it is necessary that the electromagnetic sound generator itself be reduced in thickness and size. In particular, since the thickness of the electromagnetic sound generator is decided by the internal structure and mounting method of the sound generator, it is necessary to modify the internal structure and change the mounting method. However, the state of the art is such that achieving a further decrease in thickness is extremely difficult.

SUMMARY OF THE INVENTION

Accordingly, an object of the present invention is to provide a mounting structure for an electromagnetic sound generator, the structure making it possible to reduce thickness without altering the internal structure of the electromagnetic sound generator or the method of mounting the same.

According to the present invention, the foregoing object is attained by providing a structure for mounting an electromagnetic sound generator, comprising: an electromagnetic sound generator having a case, an electromagnet housed inside the case and formed by attaching a magnet and a coil to a yoke, a vibrating plate housed inside said case and disposed so as to face the electromagnet, and electrodes, to which terminals of the coil are connected, projecting outwardly of the case; and a substrate having an accommodating portion conforming to the case of the electromagnetic sound generator, and substrate electrodes provided on the surface of the substrate at the circumference of the accommodating portion, the electromagnetic sound generator being mounted on the substrate by accommodating the case of the electromagnetic sound generator in the accommodating portion of the substrate and joining the electrodes of the electromagnetic sound generator to the substrate electrodes of the substrate.

In the present invention, the accommodating portion is a through-hole, a recess or cut-out.

In the present invention, the electromagnetic sound generator has a dummy electrode projecting outwardly of the case, and the dummy electrode also is joined to a substrate electrode on the substrate.

Furthermore, according to the present invention, portions of the electrodes of the electromagnetic sound generator projecting outwardly of the case are joined to the substrate electrodes of the substrate in such a manner that an upper surface or lower surface of each projecting portion is superimposed on a respective one of the substrate electrodes.

The present invention further provides an electromagnetic- sound generator comprising a case; an electromagnet housed inside the case and formed by attaching a magnet and a coil having terminals to a yoke; a vibrating plate housed inside the case and disposed so as to face the electromagnet; and electrodes, to which terminals of the coils are connected, joined to substrate electrodes on the substrate; each of the electrodes having a plate-shaped configuration and projecting outwardly so as to be coplanar with a bottom surface of the case, the electrodes being joined to the substrate electrodes on the substrate in such a manner that an upper surface or lower surface of each electrode is superimposed on a respective one of the substrate electrodes.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

In a structure for mounting an electromagnetic sound generator in accordance with the present invention, a substrate is provided with an accommodating portion, the electromagnetic sound generator is received within the accommodating portion and electrodes of the electromagnetic sound generator are joined to substrate electrodes provided at the circumference of the accommodating portion. As a result, the thickness of the electromagnetic sound generator fits within the thickness of the substrate, thereby making it possible to mount the electromagnetic sound generator in a condition of greatly reduced thickness.

In addition, the electrodes of the electromagnetic sound generator can be joined to substrate electrodes on the substrate in such a manner that upper or lower surfaces of portions of the electrodes that project outwardly of a case are superimposed on the substrate electrodes. This makes it possible to change the manner in which the electromagnetic sound generator is mounted on the substrate, thereby making it possible to provide not only for accommodation in the above-mentioned accommodating portion but also for conventional surface mounting.

Figure 1:
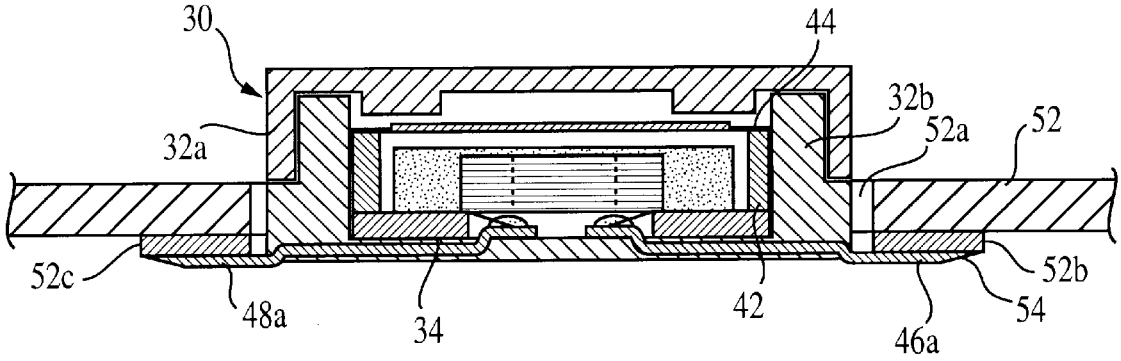
FIG. 1 is a sectional view showing a structure for attaching electrodes of an electromagnetic sound generator according to an embodiment of the present invention.
Figure 2:
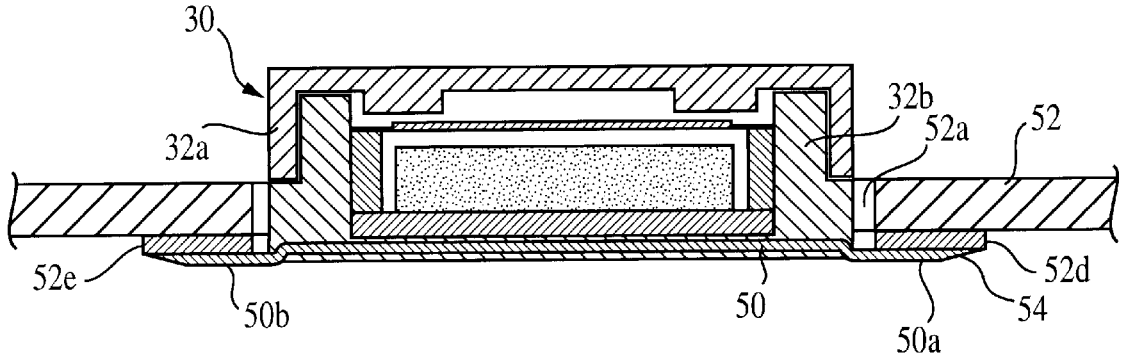
FIG. 2 is a sectional view showing a structure for attaching a dummy electrode of the electromagnetic sound generator illustrated in FIG. 1.
Figure 3:
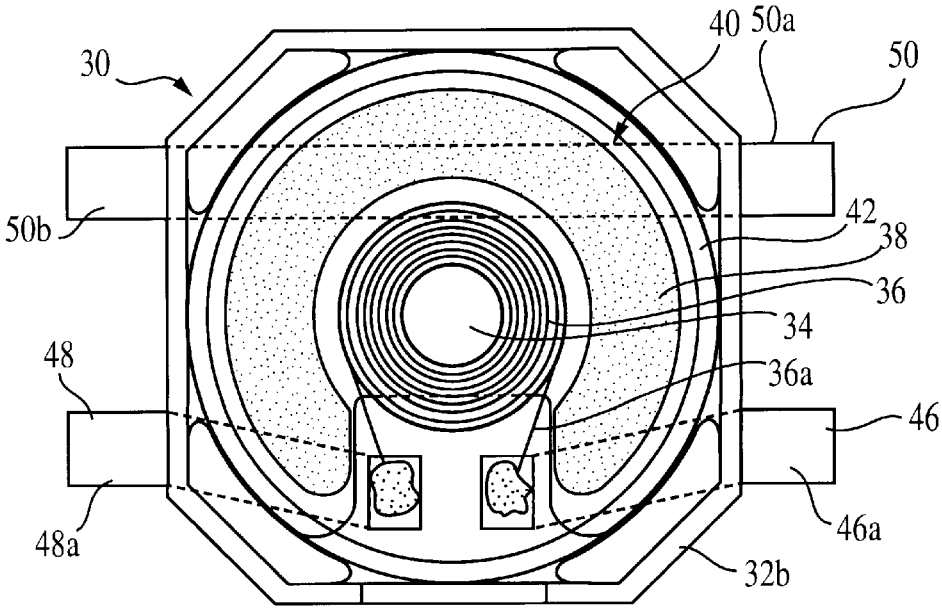
FIG. 3 is a plan view showing the internal structure of the electromagnetic sound generator of FIGS. 1 and 2 with an upper case and a vibrating plate removed.
Figure 4:
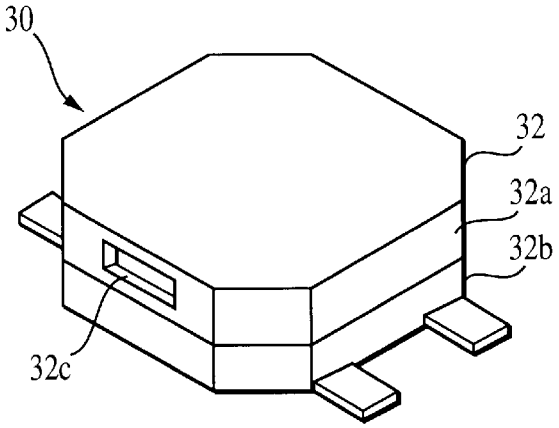
FIG. 4 is a perspective view showing the appearance of the electromagnetic sound generator of FIG. 3 covered by the upper case.

An embodiment of the present invention will now be described in detail with reference to FIGS. 1 and 2, which are sectional views showing the mounting structure of the electromagnetic sound generator according to this embodiment, FIGS. 3 and 4, which are a plan view and perspective view, respectively, illustrating the internal structure and external appearance of the electromagnetic sound generator, and FIG. 5, which is a bottom view showing the electromagnetic sound generator in the mounted state.

As shown in FIGS. 1 to 5, an electromagnetic sound generator 30 according to this embodiment includes a case 32 comprising an upper case 32*a* and a lower case 32*b*; an electromagnet 40 housed within the case 32 and comprising a yoke 34, a coil 36 attached to the yoke 34, and a C-shaped or ring-shaped magnet 38 disposed about the outer periphery of the coil 36 and attached to the yoke 34; and a vibrating plate 44 supported by a vibrating-plate support ring 42 and disposed so as to face the magnet 40.

Electrodes 46, 48 each comprising a plate-shaped lead frame and a dummy electrode 50 are insert-molded in the lower case 32*b* of the case 32 of electromagnetic sound generator 30. The electrodes 46, 48 each have one end connected to a respective coil terminal 36*a* of the coil 36 within the case 32. The other ends of the electrodes 46, 48 are formed into plate-shaped attaching connection portions 46*a*, 48*a*, respectively, projecting outwardly of the case 32. Further, the dummy electrode 50 is constituted by a single lead frame in order to provide a connection between the electromagnet 40 and the outside. The central portion of the dummy electrode 50 is insert-molded in the lower case 32*b* and both ends thereof project outwardly of the case 32 by a considerable length to form plate-shaped attaching portions 50*a*, 50 *b*.

A substrate 52 on which the electromagnetic sound generator 30 is mounted is provided with an accommodating portion 52*a* which is a through-hole that conforms to the electromagnetic sound generator 30, and substrate electrodes 52*b* to 52*e* disposed on the surface of the substrate at the circumference of the accommodating portion 52*a*.

In this embodiment of the present invention, the electromagnetic sound generator 30 is received within the accommodating portion 52*a* of substrate 52, at which time the upper surfaces of the attaching connection portions 46*a*, 48*a* of electrodes 46, 48 and the upper surfaces of the attaching portions 50*a*, 50*b* of dummy electrode 50 are superimposed on respective ones of the substrate electrodes 52*b* to 52*e* so as to make contact therewith. The attaching connection portions 46*a*, 48*a* and the attaching portions 50*a*, 50*b* are joined to respective ones of the substrate electrodes 52*b* to 52*e* by solder 54. Since the substrate 52 in this embodiment is thinner than the electromagnetic sound generator 30, the electromagnetic sound generator 30 protrudes from the opposite side of the substrate 52 when it is received within the accommodating portion 52*a*. However, in comparison with an arrangement in which the electromagnetic sound generator 30 is surface mounted on the surface of the substrate 52, the electromagnetic sound generator 30 recedes by an amount equivalent to the thickness of the substrate 52, as a result of which a reduction in the direction of thickness is achieved.

Figure 6:
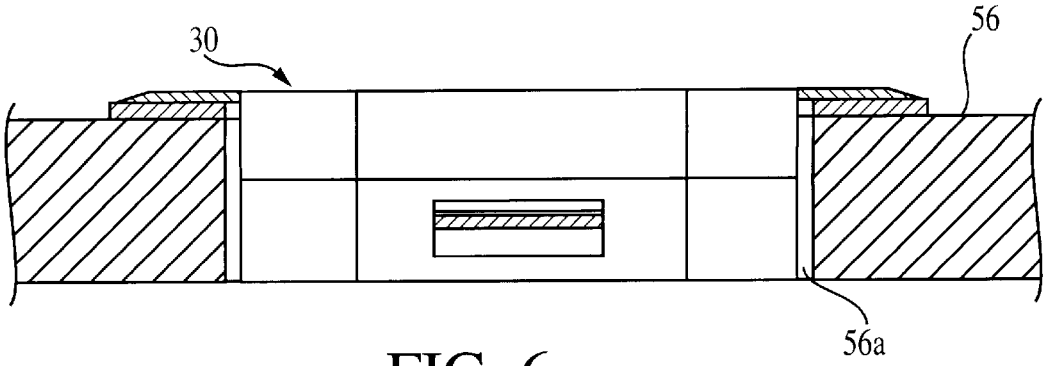
FIG. 6 is a sectional view showing the electromagnetic sound generator in the mounted state in a case where the sound generator fits within the thickness of the substrate.

In a case where a substrate 56 having a thickness approximately the same as that of the electromagnetic sound generator 30 is provided with an accommodating portion 56*a* which is a through-hole, as shown in FIG. 6, the electromagnetic sound generator 30 can be received within the thickness of the substrate 56 by accommodating the electromagnetic sound generator 30 inside the accommodating portion 56*a*.

Figure 7:
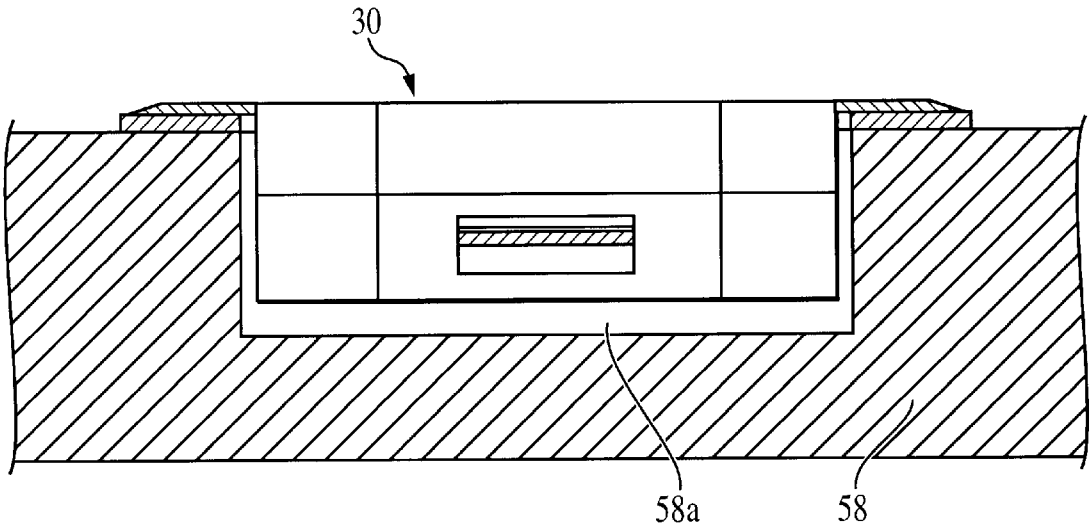
FIG. 7 is a sectional view showing the electromagnetic sound generator in the mounted state in a case where the sound generator is accommodated in an accommodating portion comprising a recess.

In a case where a substrate 58 is thicker than the electromagnetic sound generator 30, as shown in FIG. 7, the substrate is formed to have an accommodating portion 58*a* comprising a recess that conforms to the electromagnetic sound generator 30. The electromagnetic sound generator 30 can be received within the thickness of the substrate 58 by accommodating the electromagnetic sound generator 30 inside the accommodating portion 58*a*.

Figure 8:
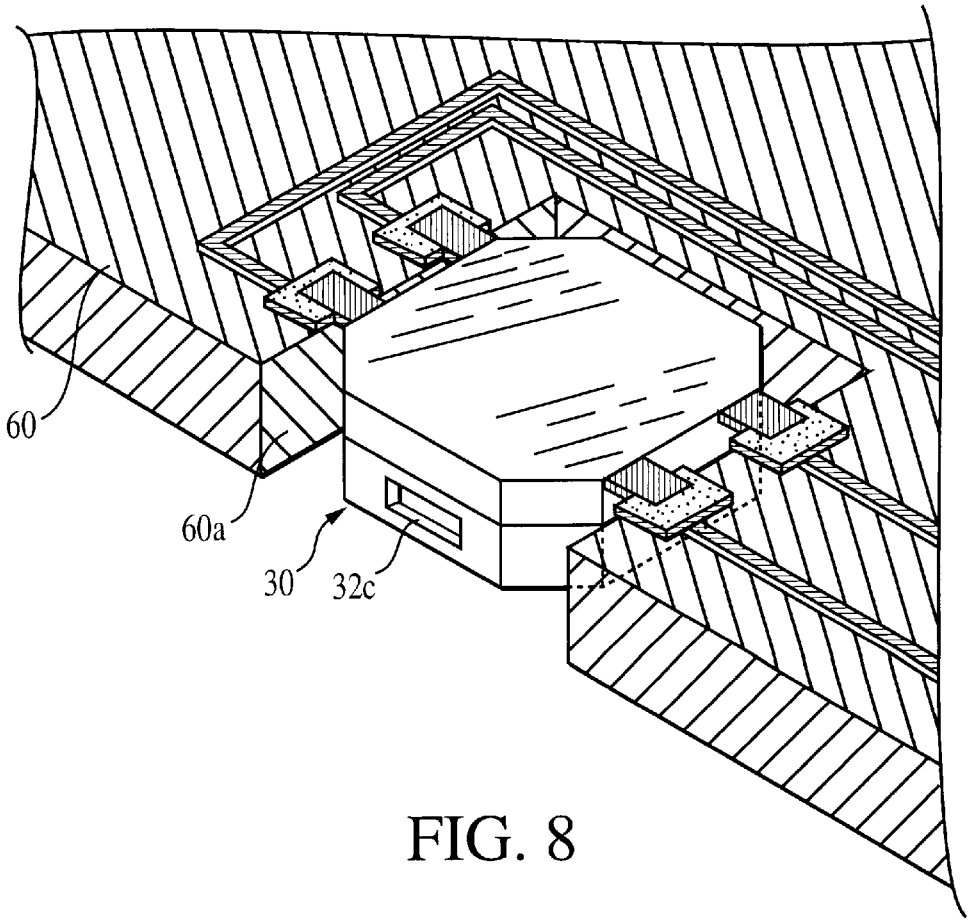
FIG. 8 is a perspective view showing the electromagnetic sound generator in the mounted state in a case where the sound generator is accommodated in an accommodating portion comprising a cut-out.

In an arrangement in which the side face of the case 32 is provided with a sound emitting opening 32*c*, as in the manner of the electromagnetic sound generator 30 according to this embodiment, a substrate 60 may be provided formed to have an accommodating portion 60*a*, which comprises a cut-out formed in the side face of the substrate, and the electromagnetic sound generator 30 may be received within the accommodating portion 60*a* in a state in which the sound emitting opening 32*c* is faced toward the opening of the cut-out, as shown in FIG. 8, in order to improve the carry of the sound generated.

Figure 5:
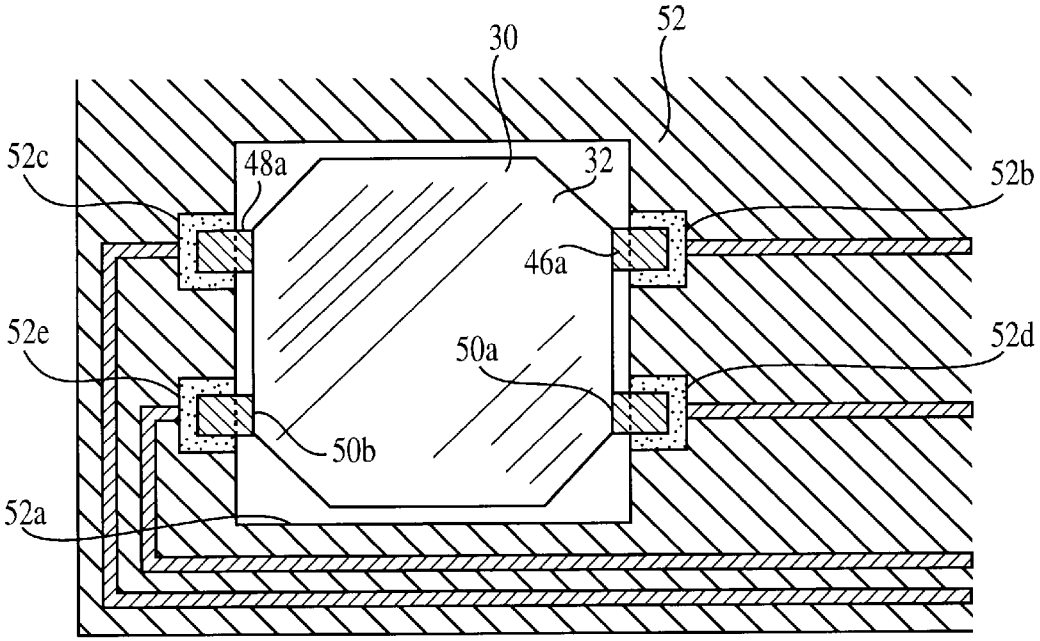
FIG. 5 is a bottom view of a substrate with the electromagnetic sound generator of FIGS. 1 and 2 in the mounted state.
Figure 9:
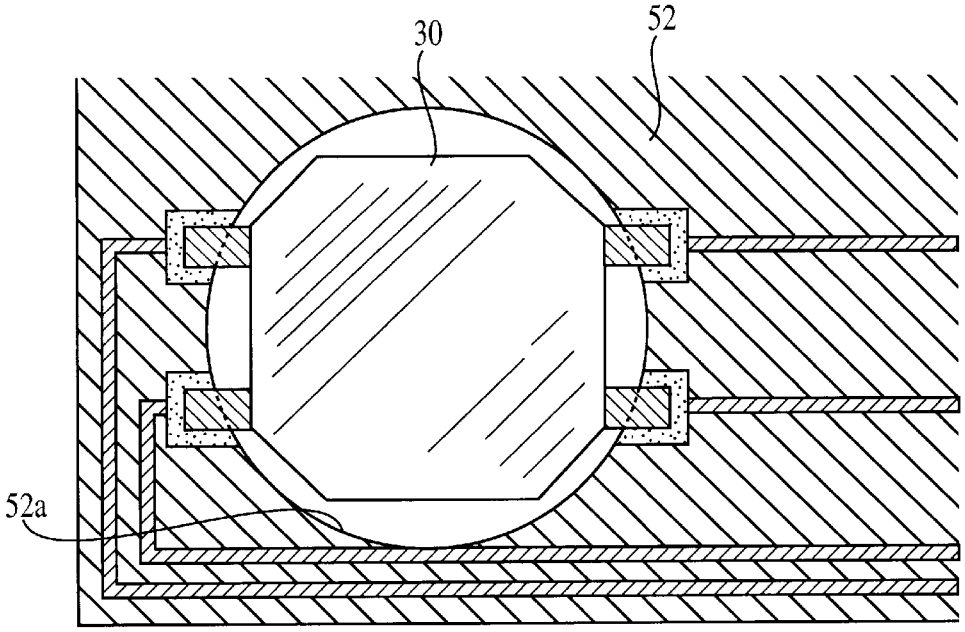
FIG. 9 is a bottom view of the substrate illustrating another example of the shape of the recessed portion in a plane.
Figure 10:
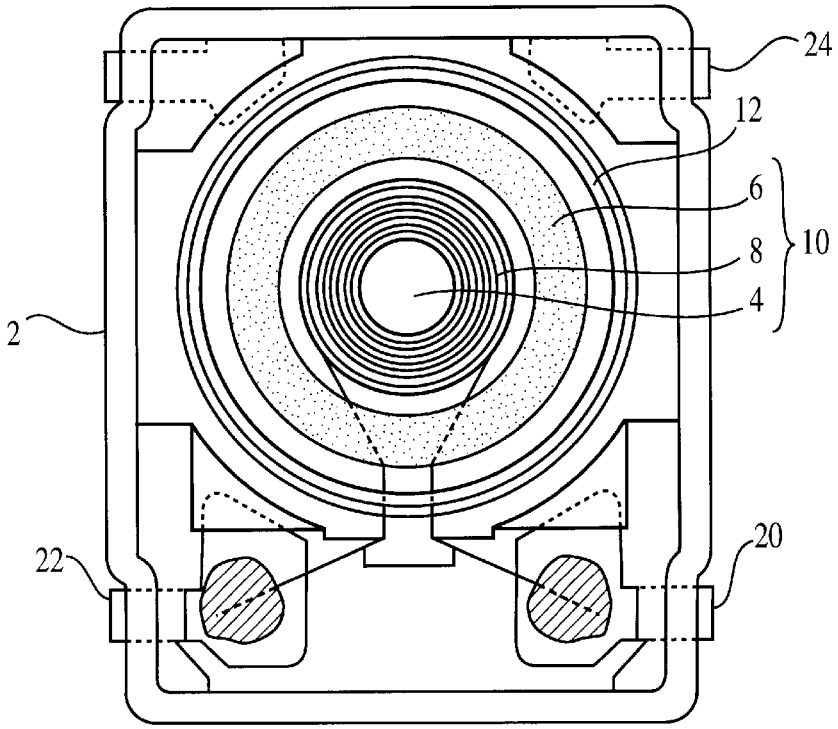
FIG. 10 PRIOR ART
FIG. 10 is a plan view showing the internal structure of a electromagnetic sound generator according to the prior art with an upper cover and a vibrating plate removed.
Figure 11:
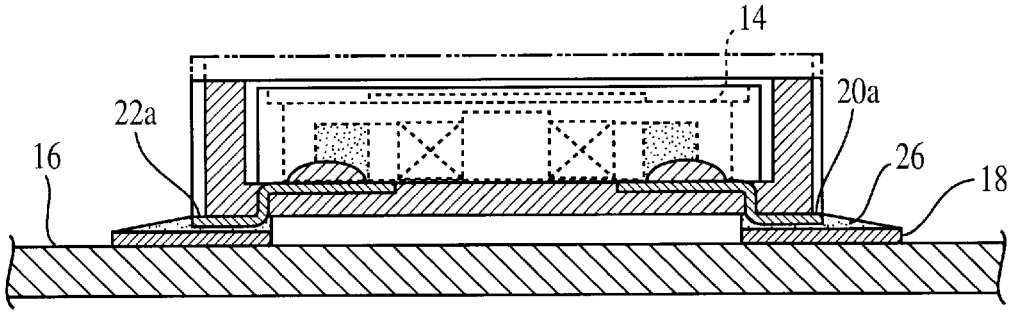
FIG. 11 PRIOR ART
FIG. 11 is a sectional view showing a structure for attaching electrodes of the electromagnetic sound generator illustrated in FIG. 10.
Figure 12:
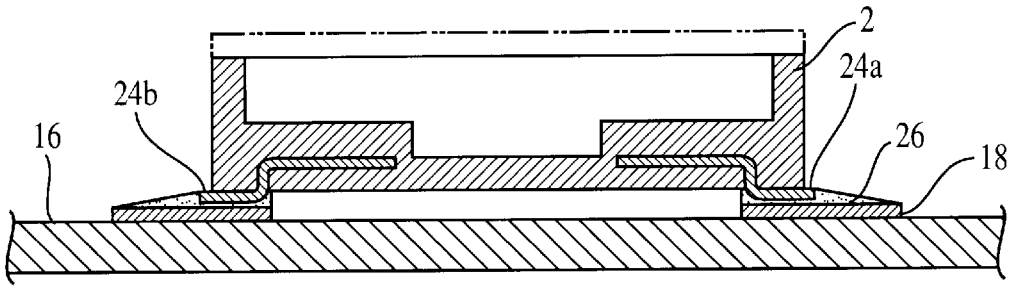
FIG. 12 PRIOR ART
FIG. 12 is a sectional view showing a structure for attaching a dummy electrode of the electromagnetic sound generator illustrated in FIG. 10.
Figure 13:
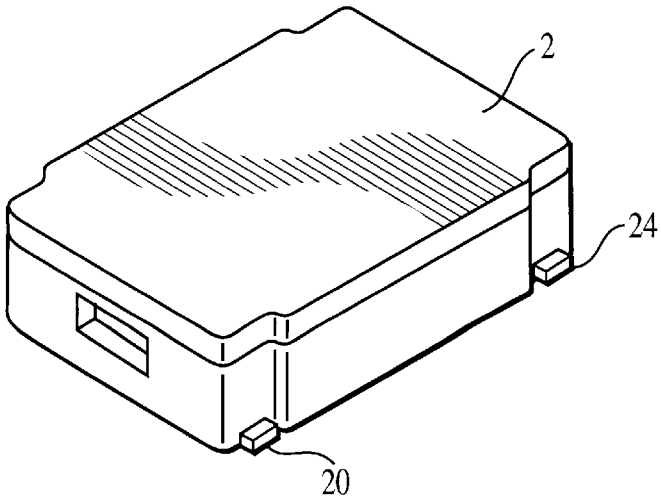
FIG. 13 PRIOR ART
FIG. 13 is a perspective view showing the appearance of the electromagnetic sound generator of FIG. 10 covered by the upper cover.
Figure 14:
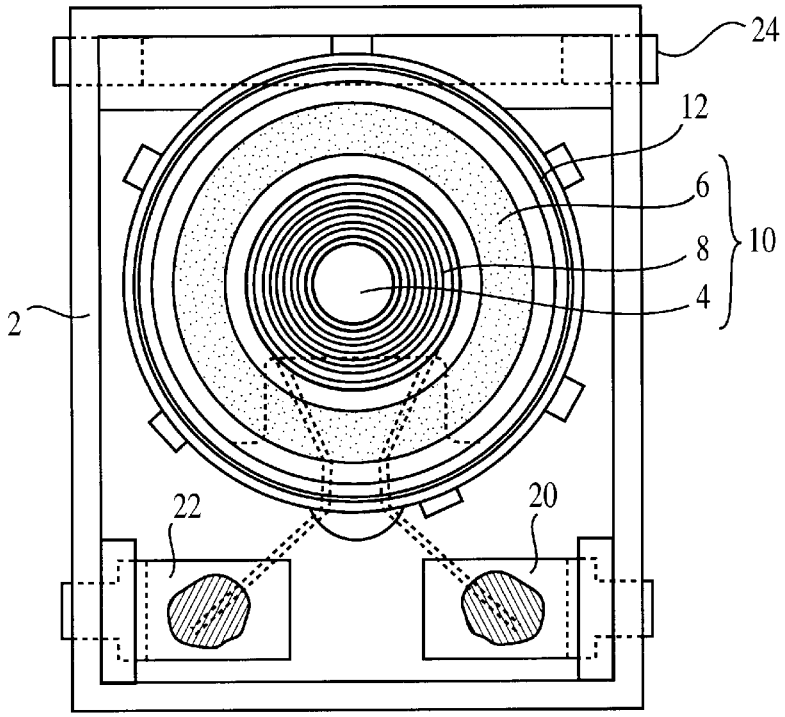
FIG. 14 PRIOR ART
FIG. 14 is a plan view showing the internal structure of an electromagnetic sound generator according to another example of the prior art with an upper cover and a vibrating plate removed.
Figure 15:
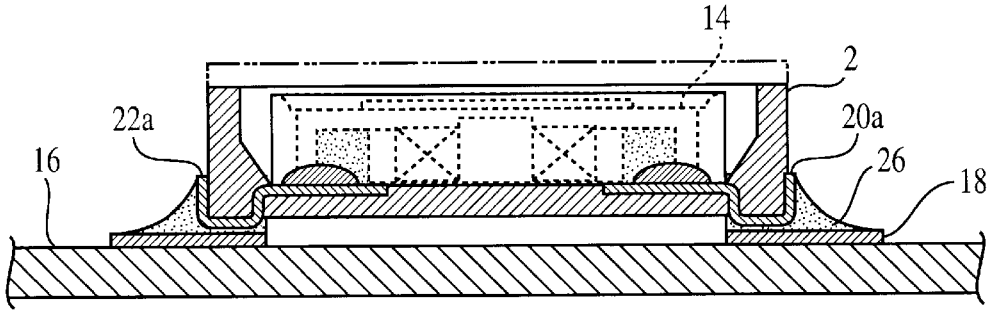
FIG. 15 PRIOR ART
FIG. 15 is a sectional view showing a structure for attaching electrodes of the electromagnetic sound generator illustrated in FIG. 14.
Figure 16:
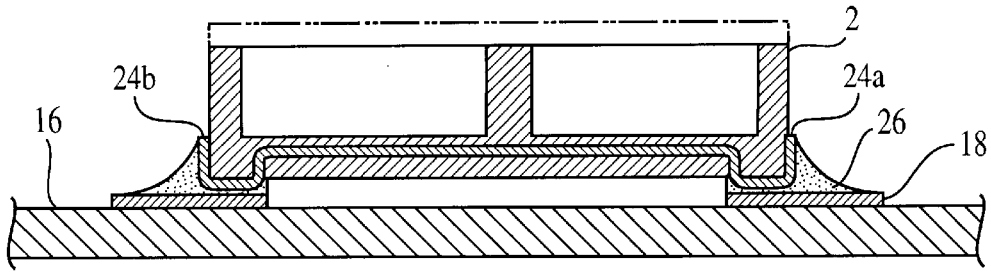
FIG. 16 PRIOR ART
FIG. 16 is a sectional view showing a structure for attaching a dummy electrode of the electromagnetic sound generator illustrated in FIG. 14.
Figure 17:
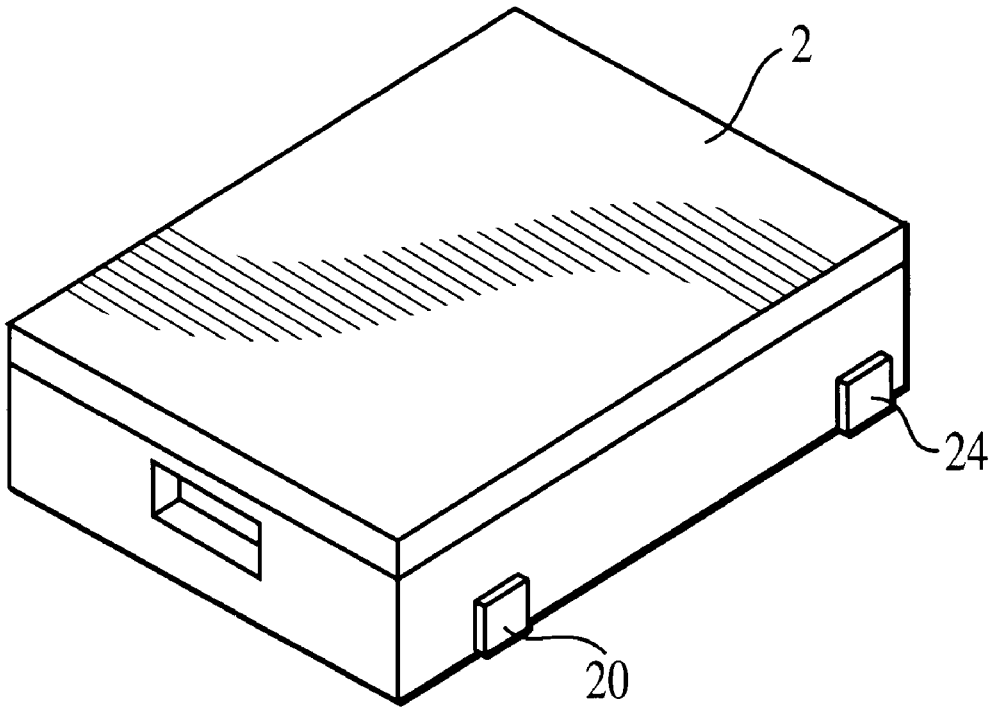
FIG. 17 PRIOR ART
FIG. 17 is a perspective view showing the appearance of the electromagnetic sound generator of FIG. 14 covered by the upper cover.

The shape of the accommodating portion 52*a*, etc., in the plane of the substrate 52, etc. may be rectangular, as shown in FIG. 5, or circular, as depicted in FIG. 9. Furthermore, the planar shape of the accommodating portion 52*a*, etc. can be modified at will depending upon the external shape or mounting density of the electromagnetic sound generator 30.

In accordance with the present invention, the case portion of an electromagnetic sound generator is accommodated within an accommodating portion of a substrate, thereby making it possible to reduce the height of the electromagnetic sound generator mounted on the substrate and to receive the case within the thickness of the substrate. As a result, an extremely slender mounting structure can be provided.

The case of the electromagnetic sound generator does not require major modification and a special technique for joining the electrodes also is not required. As a result, it is possible to support both automatic mounting and reflow soldering in the same manner as the conventional mounting method, modifying the manufacturing facilities is not necessary and mixed production, in which this electromagnetic sound generator can be produced along with that of the conventional type, is possible.

Furthermore, whether the upper or lower surface of an electrode is to be joined to a substrate electrode on a substrate can be selected at will. This makes it possible to surface mount the electromagnetic sound generator on the surface of a substrate in a manner the same as conventionally. Thus there is the option of selecting either of two mounting structures.

In a case where the electromagnetic sound generator is received within the thickness of the substrate, substrates after the electromagnetic sound generators have been mounted thereon can be stacked for retention and loading, thereby facilitating storage and transport.

In addition, the case and electrodes of the electromagnetic sound generator do not require special working or machining and there is no increase in the number of component parts. Thus the invention is economical because there is no increase in the cost of parts and manufacture.

As many apparently widely different embodiments of the present invention can be made without departing from the spirit and scope thereof, it is to be understood that the invention is not limited to the specific embodiments thereof except as defined in the appended claims.

What is claimed is:

1. A structure for mounting an electromagnetic sound generator, comprising:

an electromagnetic sound generator having:

a case;

an electromagnet housed inside said case and formed by attaching a magnet and a coil having terminals to a yoke;

a vibrating plate housed inside said case and disposed so as to face said electromagnet; and electrodes having one end connected to the terminals of said coil, respectively, and the other end formed into long plate-shaped attaching connection portions, respectively, said attaching connection portions projecting outwardly of said case; and a substrate having:

an accommodating portion conforming to the case of said electromagnetic sound generator; and substrate electrodes provided on the surface of the substrate at the circumference of said accommodating portion;

said electromagnetic sound generator being mounted on said substrate by accommodating said case in said accommodating portion of the substrate and joining said attaching connection portions of said electrodes of said electromagnetic sound generator to said substrate electrodes of the substrate, and being supported by said electrodes of said electromagnetic sound generator.

2. The structure according to claim 1, wherein said accommodating portion is a through-hole, recess or cut-out.

3. The structure according to claim 1 or 2, wherein said electromagnetic sound generator has a dummy electrode having a long plate-shaped attaching portion projecting outwardly of said case, said attaching portion of said dummy electrode also is joined to a substrate electrode on said substrate, and said dummy electrode supports said electromagnetic sound generator.

4. The structure according to claim 1, wherein said attaching connection portions of said electrodes of said electromagnetic sound generator are joined to said substrate electrodes of the substrate in such a manner that an upper surface or lower surface of each attaching connection portion is superimposed on a respective one of said substrate electrodes being provided on a lower or upper surface of said substrate.

5. A structure for mounting an electromagnetic sound generator, comprising:

an electromagnetic sound generator having:

a case;

an electromagnet housed inside said case and formed by attaching a magnet and a coil having terminals to a yoke;

a vibrating plate housed inside said case and disposed so as to face said electromagnet; and electrode having one end connected to the terminals of said coil, respectively, and the other end formed into long plate-shaped attaching connection portions, respectively, said attaching connecting portions projecting outwardly of said case;

a dummy electrode having a plate-shaped attaching portion projecting outwardly of said case; and a substrate having:

an accommodating portion conforming to the case of said electromagnetic sound generator and is a trough-hole, recess or cut-out; and substrate electrodes provided on the surface of the substrate at the circumference of said accommodating portion;

said electromagnetic sound generator being mounted on said substrate by accommodating said case in said accommodating portion of the substrate and joining said attaching connection portions of said electrodes and said attaching portion of said dummy electrode of said electromagnetic sound generator to said substrate electrodes of the substrate, and being supported by said electrodes and dummy electrode of said electromagnetic sound generator.

* * * * *